United States Patent [19]

Giancarlo et al.

[11] Patent Number: 4,964,178

[45] Date of Patent: Oct. 23, 1990

[54] SAFETY HELMET FOR MOTOR-CYCLISTS PROVIDED WITH MANUALLY-ADJUSTABLE VENTILATION MEANS

[75] Inventors: Gazia Giancarlo, Rome; Nocchi Marzio, Mozzo, both of Italy

[73] Assignee: Nolan S.p.A., Mozzo, Italy

[21] Appl. No.: 274,378

[22] Filed: Nov. 21, 1988

[30] Foreign Application Priority Data

Dec. 15, 1987 [IT] Italy ..... 22994 A/87

[51] Int. Cl.[5] ..... A42B 3/02; A42C 5/04

[52] U.S. Cl. ..... 2/414; 2/171.7

[58] Field of Search ..... 2/171.4, 171.7, 410, 2/411, 412, 414, 415, 425

[56] References Cited

U.S. PATENT DOCUMENTS 3,496,854 2/1970 Feldmann et al. ..... 2/410 X 4,115,874 9/1978 Hasegawa ..... 2/425

4,434,514 3/1984 Sundahl et al. ..... 2/425

4,622,700 11/1986 Sundahl ..... 2/425

4,704,746 11/1987 Nana ..... 2/425 X

FOREIGN PATENT DOCUMENTS 252243 1/1988 European Pat. Off. .

2167285 5/1986 United Kingdom .

*Primary Examiner*—Wm. Carter Reynolds

*Attorney, Agent, or Firm*—Collard, Roe & Galgano

[57] ABSTRACT

Safety helmet for motor-cyclists and the like, provided at the top of its cap with at least one air intake, above which an aerodynamic, shaped guide fin is installed, which determines a suction of air from the interior of the helmet, between said aerodynamic guide fin and the external surface of the cap an adjustable slider element being provided, which is suitably shaped and positioned, and acts both as a baffle plate, and as a shutter for controlling the air flow.

8 Claims, 3 Drawing Sheets

SAFETY HELMET FOR MOTOR-CYCLISTS PROVIDED WITH MANUALLY-ADJUSTABLE VENTILATION MEANS

DESCRIPTION

The present invention relates to a safety helmet for motor-cyclists and sportsmen, in general, who use safety helmets, which safety helmet is equipped with means for the internal ventilation, and has such a structure as to favour a regular and controlled escape towards to external environment of the warm air and/or of the condensate accumulated inside the helmet during its use, and such as to efficaciously carry out its intended function also at low speeds, at which a larger heat build-up occurs, owing to very limited heat exchanges.

It is well known that the safety helmets for motor-cyclists and in general for those who take part to sport contests which require the use of a safety helmet, are made in the form of a complete cap which, in case of integral helmets, is provided in its front side, in correspondence of the user's eyes, with an opening which can be closed by means of a liftable and/or removable transparent visor.

The helmets are normally provided with an external cap or shell, made from a rigid and strong material, such as polycarbonate, or the like, or composite materials, inside which a safety padding is coupled, e.g., made from polystyrene or foamed polyurethane; with this safety padding a lining is then associated, which is made from a soft material, which constitutes a comfort padding.

Analogous structures are displayed as well by the helmets of the open type, commonly named either "Jet" or "Demijet" helmets. The integral helmets, above all due to their particular enclosing structure, involve the need of being internally ventilated by causing an air stream to circulate inside them, in order to prevent the helmet user's head from overheating, and condensate to be formed due to the user's perspiration. In order to accomplish a proper ventilation inside the helmet, several solutions were proposed in the past, which are substantially based on the principle of intaking an air stream from the outside by means of bores or openings provided in the front portion of the helmet, of making said air stream circulate through the padding layers by means of suitable, variously shaped and positioned air channels, and of subsequently venting said air stream from the rear portion of the same helmet, in the nearby of the user's nape, or anyway of the user's occipital region.

A form of safety helmet is known as well, which is provided with frontal air intakes, in the lowest frontal portion thereof, with air flowing inside the helmet and being vented to the outside both from the side portions of the helmet, and from the top of the cap wherein an inclined guide fin, positioned ahead of air intakes provided in the same cap, creates such a depressure as to cause the warm air inside the helmet to be sucked towards the external atmosphere.

All of the practical embodiments known from the prior art, which are provided with direct air intakes by means of openings provided either in the front top portion of the helmet, in correspondence of the user's forehead, or in the helmet's low portion, in correspondence of the user's chin, in practice determine troublesome localized cooling conditions, above all at high speeds, and an insufficient ventilation at low speeds, owing to the pressure drops which the air flow undergoes inside the channels, the deflection openings and the vents.

Furthermore, inasmuch as at high speeds the air stream flowing inside the air channels is very fast, conditions may arise, which are troublesome for the driver's face and eyes, as well as undesirable air jets may be established in the driver's occipital region.

Therefore, a purpose of the present invention is to provide a safety helmet equipped with air suction means external to the same helmet, which are given such a structure as to favour the expulsion of the warm air built up inside the helmet during the use thereof, and, in particular, at the low speeds, during which heat tends to accumulate to a larger extent, owing to the very limited heat exchanges, thus overcoming all the disadvantages and troublesome feelings affecting the ventilation systems known from the prior art.

Another purpose of the present invention is to provide an integral helment in which said suction means, thanks to their particular aerodynamic shape and position relatively to the helmet's cap, are such as to locally generate, in correspondence of bores or openings provided in the rigid cap, an increase in the speed of the air flow lapping said means, and therefore a consequent reduction in the local pressure; such a decrease in pressure causes therefore the warm air inside the helmet to be sucked in correspondence of said bores or openings.

A further purpose of the present invention is to provide a helmet equipped with such intake means as to result to be simple and cheap to manufacture, aesthetically pleasant, and also applicable, without any substantial modifications, to the already known and existing helmet types.

These, and still other purposes, which are shown more clearly in the following disclosure, are achieved by a safety helmet equipped with channels for the internal ventilation, which helmet is provided according to the present invention, at the top of its rigid cap, with at least one opening or air intake, provided in the same cap, above which a shaped aerodynamic guide fin is positioned at a short distance from the external surface of the cap, so as to create, between the cap and the guide fin, a duct having a cross-section decreasing towards the rear portion of the helmet, capable of enabling an air stream flowing through said duct to locally undergo, in correspondence of said air intake, a speed increase, with such a decrease in the local pressure as to determine a suction of warm air from the interior of the helmet, with said warm air flowing towards the outside through the outlet of said air intake, with between said guide fin and the external surface of said cap an adjustment element of slider type being provided, guided on said guide fin, and manually adjustable in correspondence of said air intake, with said slider being so shaped and positioned as to constitute, besides a flow shutter, also a baffle plate, capable of favouring the intake of warm air from the interior of the helmet.

More particularly, said flow shutter slider is positioned, with possibility of translation, above said air intake, e.g., by means of a protruding pin guided inside a slot in the guide fin, and is constituted by a substantially wedge-shaped plate having a decreasing thickness, positioned between the cap and the guide fin, with its lowermost-thickness side being directed towards the air inlet of the duct, and with its base being in constant contact with the cap, whilst the opposite side is maintained spaced apart from the downwards-facing surface of said guide fin; by means of the translation of the slider above the air intake, wherein said slider can be translated up to totally shut the same air intake, the adjustment is obtained of the flow rate of the air stream, and a depressure is achieved in correspondence of the air intake, which is suitable for favouring the suction of the warm air from the interior of the helmet.

Finally, on the inner surface of said guide fin longitudinal ribs are present, which are so shaped and spaced apart from each other, as to maintain an unidirectional and laminar air flow, besides acting as stiffening elements for the same guide fin. Additionally to the ribs provided on said guide fin, or alternatively to them, other ribs and/or grooves can be present on the outer surface of the cap, in correspondence of the region of the cap which is covered by said guide fin, in order to maintain, or cooperate to maintain, said air stream unidirectional and under laminar flow conditions.

According to a form of practical embodiment of the present invention, in correspondence of said vent bores a lenticular hollow is provided inside the thickness of the layer of the safety padding in a position adjacent to the inner surface of the cap, with the surface area of said lenticular hollow being equal to at least three times the total surface area of said vent bores. In fact, practical experimental tests carried out inside the wind tunnel and with other suitable apparatuses, have shown that said suction of warm air from the interior of the helmet results to be considerably and advantageously potentiated by such a lenticular hollow. Still according to the present invention, the shape of the slider, and, in particular, of the rear wing thereof, is defined by way of experiments inside the wind tunnel, and is suitable for preventing phenomena of turbulence in said air stream.

The invention is disclosed in greater detail hereinunder, according to preferred and non-exclusive forms of practical embodiment, with reference to the hereto attached drawing tables, supplied for merely illustrative and non-limitative purposes, wherein:

FIG. 1 schematically shows an exploded view of a safety helmet equipped with the means for inner ventilation according to the present invention;

FIG. 2 shows an also schematic sectional view taken through the middle of the helmet according to the II—II path, of the top portion of the helmet of FIG. 1, with the ventilation device being stably applied:

FIGS. 3 and 4 respectively show a side view and a top view of the helmet of the preceding figures;

Referring to such figures, the therein depicted helmet is constituted by a rigid external cap 1, made, e.g., from polycarbonate, from composite material, or the like, with the interior of which a lining 2 of foamed material, or the like, such as foamed polystyrene or polyurethane, and a further inner lining 8 of a soft material, constituting a comfort padding, being associated.

Figure 7:
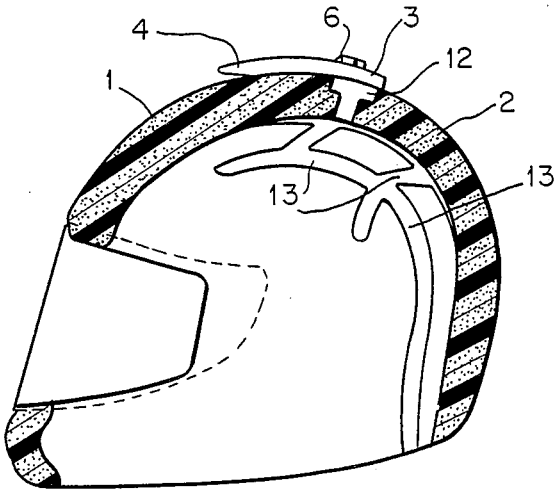
FIG. 7 shows a schematic sectional view of the helmet of FIG. 1, showing the channels for the internal ventilation.

Inside the helmet branched channels 13 of FIG. 7 are provided according to various techniques known from the prior art, for enabling cooling air to circulate, which are placed in communication with air intakes or bores in the frontal portion of the helmet and/or in correspondence of the chin, and with the vent openings for the warm air to be vented.

According to the invention, the channels provided inside the cap and the padding are in communication with the air vent openings 3, in a number preferably ranging from one to three, and positioned atop the cap, and through them the warm air formed inside the helmet is sucked and is subsequently vented to the external atmosphere. Such air intakes can run in the vertical direction, as shown in FIG. 2, or inclined towards the rear portion of the helmet cap 1, in order to favour the expulsion of the warm air, as it will be clarified in the following.

Figure 2:
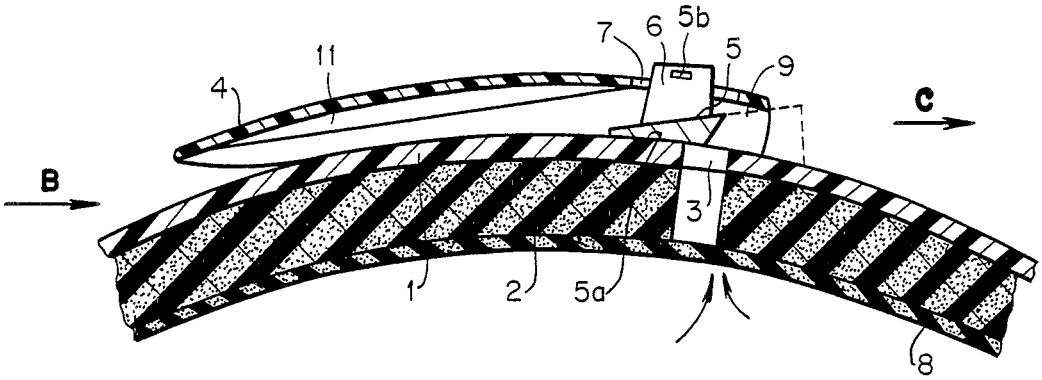

In order to accomplish, according to the invention, a suction of warm air through the air intakes 3, above the same air intakes a guide fin 4 is stably positioned, which is substantially constituted by a sheet of a plastic material, or the like, substantially curved according to the radius of curvature of the cap 1, of a substantially trapezoidal shape with the larger base thereof being positioned towards the front portion of the helmet, and kept spaced apart from the same cap 1 and so shaped as to form a duct suitable for giving an air stream entering according to the arrow B (FIG. 2) an increase in speed in correspondence of the air intakes 3 and hence a localized decrease in pressure, which determines a suction of the warm air which is inside the helmet in correspondence of the inlet of the air intakes and said warm air to be consequently vented to the atmosphere according to the arrow C (FIG. 2).

Figure 5:
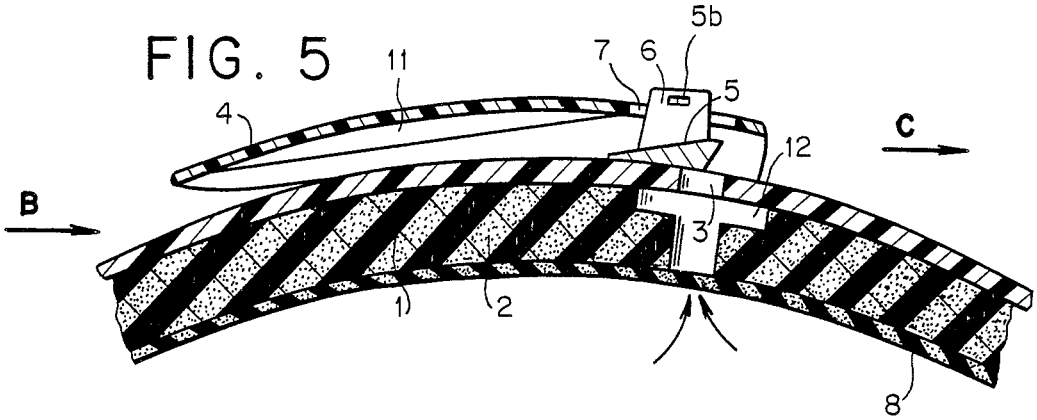
FIG. 5 shows the same middle sectional view of the top portion of the helmet of FIG. 2, according to a different form of practical embodiment of the present invention.

According to a different form of the present invention (FIG. 5), a lenticular hollow 12 is provided inside the thickness of the layer of the safety padding 2, with the surface area of said lenticular hollow being equal to at least three times the total surface area of said vent bores 3, said hollow having the purpose of considerably favouring the suction of the warm air from the interior of the helmet.

Figure 4:
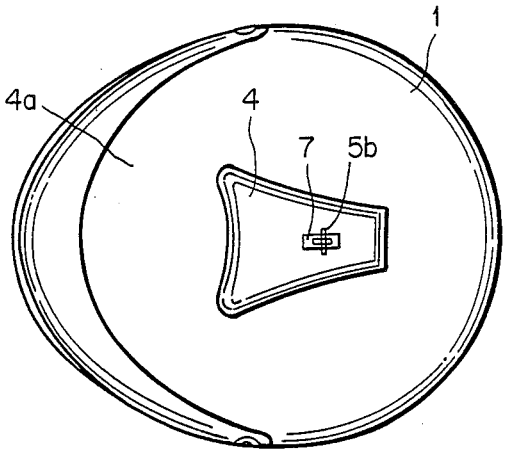

Said guide fin 4 has a shape converging towards the rear end of the helmet (FIG. 1 and FIG. 4), i.e., a substantially trapezoidal shape with the larger base **4*a* directed towards the front portion of the helmet, and the smaller base 4*b* directed towards the rear portion thereof. In other terms, said guide fin has an aerodynamic shape, experimentally defined by using wind tunnels, in order to obtain the best conditions for air suction, and laminar and not turbulent flow conditions. Between the guide fin 4 and the cap 1 there is inserted a slider body 5, substantially having a wedge shape, translatable above the air intakes by means of an extension, i.e., a pin 6, guided inside a slot 7, provided in the guide fin 4. The slider 5 can be thus shifted in both directions by manually acting on the end of the pin, protruding outside from the guide fin; the stable locking of the slider is achieved by means of known means, e.g., by means of a transversal pin 5*b*** translatable on a toothed surface, or the like.

Furthermore, the slider 5 has its smallest-thickness end directed towards the air inlet to the duct between the guide fin and the cap, and is so positioned as to have its base plane **5*a*** into a constant contact with the cap, and the opposite end at a preestablished distance from the guide fin.

As already said, the shape of the slider, and, in particular, of its rear wing, is drawn on the basis of experimental tests, so as to eliminate, or at least minimize the phenomena of turbulence in the air stream. Said slider makes it possible the air flow entering the duct to be gradually adjusted, i.e., the air stream to be choked up to the total shutting of the air intakes, and simultaneously, owing to the effect of the inclination by a given angle "i" between the upper surface of the slider and the surface of the cap 1, it constitutes a baffle which favours the orientation of the air threads or air stream, and therefore the increase in the dynamic pressure of the air stream flowing between the upper surface of the slider and the inner surface of the guide fin 4; consequently, a reduction of the static pressure in the region of the air intakes is obtained, which accomplishes the suction of the warm air. Thanks to the presence of the cursor-baffle 5, it is also possible to accomplish the bores 3 in a substantially vertical, rather than inclined, position, thus considerably facilitating the process of moulding of the cap and of the bores, when these are made in a subsequent step.

Figure 1:
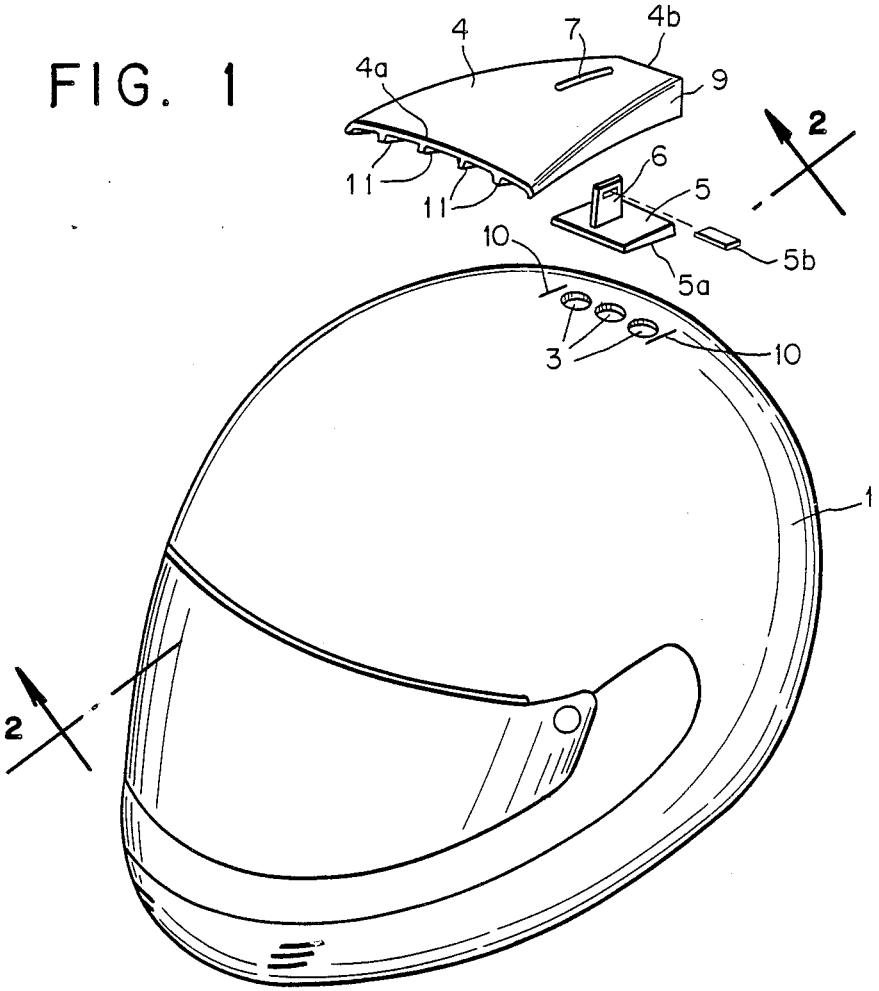
Figure 3:
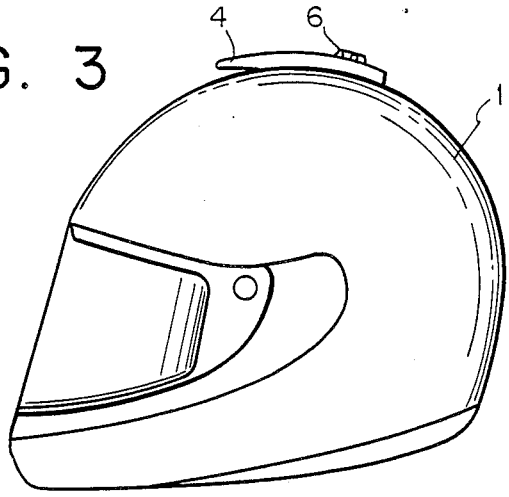

Still according to the invention, the guide fin 4 is designed and accomplished in such a way as to have two side rear edges 9, such as to make it possible the guide fin to be anchored to the same cap by means of known means, such as adhesive-bonding, locking pins, and the like; on the external surface of the cap, also slots 10 can be provided, in correspondence of which said side support edges 9 can be positioned (FIG. 1). Finally, on the downwards-facing surface of the guide fin 4, longitudinal ribs 11 are provided, which, besides constituting stiffening elements for the same guide fin, perform the function of maintaining the unidirection air flow under laminal conditions, in order to prevent any occurrences of phenomena of turbulence, and hence of areas in the region concerned by the suction, wherein the air flow may stop. Furthermore, said ribs should have a longitudinally variable thickness, with their junction to the guide fin having a rounded shape, in order to prevent deviating forces from arising, which can possibly generate side and longitudinal bending movements of the guide fin; such movements would be harmful for the user of the helmet, in that they would apply loads to the same user's neck.

Figure 6:
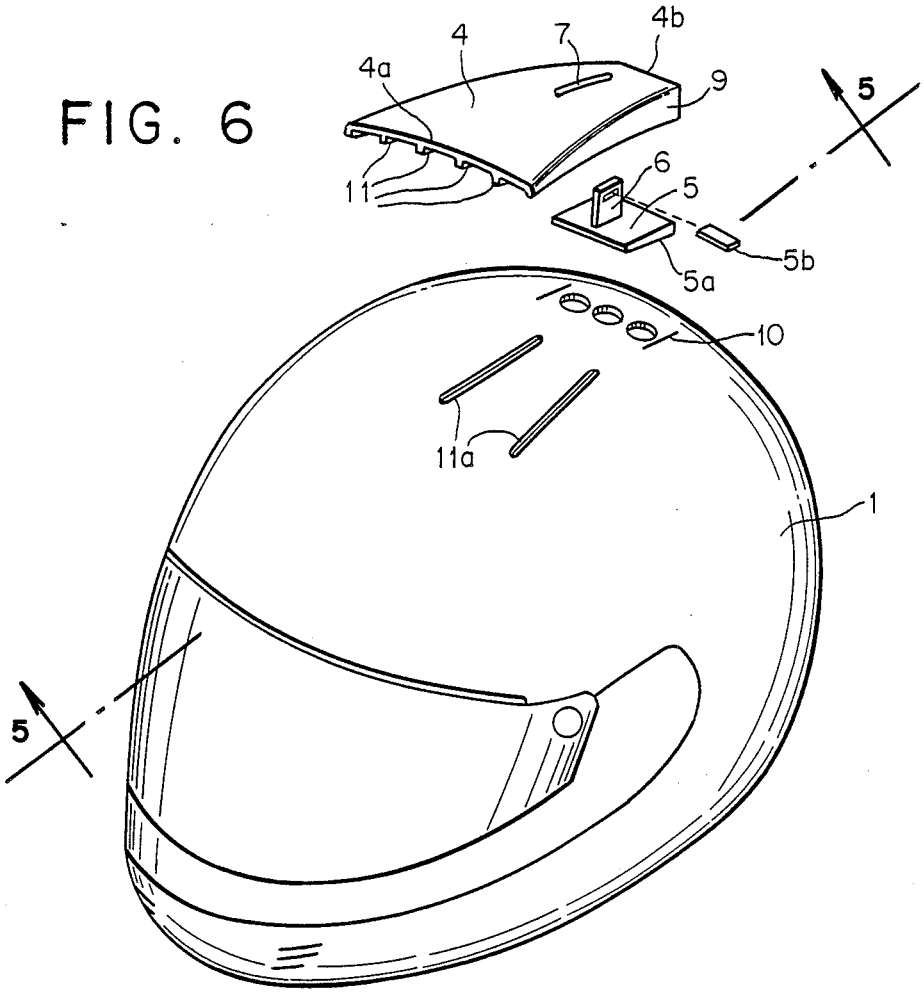
FIG. 6 shows a view of the helmet of FIG. 1, according to a further form of practical embodiment of the invention.

Besides the ribs provided on the downwards-directed surface of said guide fin, according to a different form of practical embodiment of the invention (FIG. 6), further ribs **11*a*** are provided on the outer surface of the cap, in correspondence of the region of said cap which is covered by the same guide fin, which are suitably shaped on the basis of the results of experimental tests.

In practice, in order to obtain the best results for the purposes of the intake of air from the interior of the safety helmet, the shape and the dimensions of the guide fin 4 and of the relevant ribs, as well as of the slider-baffle 5, the distance between the guide fin and the cap, and the same inclination of the baffle, as well as the size and the outline of the lenticular hollow 12, are practically defined on an experimental basis, by using the well known wind tunnels which, as known, make it possible the aerodynamic forces to be determined, which act on a body on which an air stream impinges, on the basis of which the structural and configurational characteristics of the same body can be computed.

In practice, it is also possible to apply to a helmet two side-by-side suction devices, both of which have the same structure as hereinabove disclosed, e.g., by applying two aerodynamic guide fins above air intakes provided in symmetrical positions relatively to the middle plane of the helmet, e.g., with an inclination of 10°–15° to the vertical axis.

Finally, it is obvious that to the invention, as disclosed hereinabove, structurally and functionally equivalent modifications and variants can be supplied, without departing from the scope of protection of the same finding.

We claim:

1. Safety helmet equipped with internal channels for the ventilation and the cooling of the internal area, characterized in that said helmet is provided at the top of its external rigid cap, with at least one opening or air intake, in communication with said air channels and provided in the cap and through the underlying protective layers, above which an aerodynamic guide fin is positioned at a short distance from the external surface of the cap, which is so shaped as to create, between the cap and the guide fin, a duct having a cross-section with a surface area decreasing towards the rear portion of the helmet, capable of enabling an air stream flowing through said duct to locally undergo, in correspondence of said air intake, a speed increase, with a such a decrease in the local pressure as to determine a suction of warm air from the interior of the helmet, with said warm air flowing towards the outside through the outlet of said air intake, with between said guide fin and the external surface of said cap an adjustment element of slider type being provided, guided on said guide fin, and manually adjustable in correspondence of said air intake, with said slider being so shaped and positioned as to constitute, besides a flow shutter, also a baffle plate, capable of favouring the intake of warm air from the interior of the helmet.

2. Helmet according to claim 1, characterized in that said guide fin is constituted by a sheet of plastic material, or the like, substantially curved according to the radius of curvature of the cap, and of a substantially trapezoidal shape, with the larger base thereof being positioned towards the front portion of the helmet.

3. Helmet according to claim 1, characterized in that said slider is positioned above said air intake, with the possibility of being translated, by means of a portruding element guided inside a slot in the guide fin, and manually actuatable, and is constituted by a substantially flat, wedge-shaped body having a decreasing thickness, with said wedge-shaped slider being positioned between the cap and the guide fin, with its lower base plane being into constant contact with the helmet cap, and its lowermost-thickness end being directed towards the front portion of the helmet, and with its opposite end, suitably shaped, being maintained spaced apart at a prefixed distance from said guide fin, so as to determine a decrease of the pressure in correspondence of said air intake, and make it possible, by means of its translation above the air intake, wherein said slider can be translated up to totally shut the same air intake, the adjustment to be obtained of the flow rate of the air stream.

4. Helmet according to claim 1, characterized in that on the downwards-directed surface of said guide fin longitudinal ribs are provided, which are shaped and spaced apart from each other, so as to maintain in the duct between the guide fin and the cap a unidirectional and laminar air flow, besides acting as stiffening elements for the same guide fin.

5. Helmet according to claim 1, characterized in that longitudinal ribs are provided on the outer surface of the cap, in correspondence of the region of the cap which is covered by said guide fin, in order to cooperate to maintain said air stream unidirectional and under laminar flow conditions.

6. Helmet according to claim 1, characterized in that said guide fin has, at least at its end directed towards the rear portion of the helmet, two mutually opposite side rear edges suitable for constituting means for slot-coupling inside corresponding slots provided in the cap.

7. Helmet according to claim 1, characterized in that in correspondence of said vent bores a lenticular hollow is provided inside the thickness of the layer of the safety padding in a position adjacent to the inner surface of the helmet cap, with the surface area of said lenticular hollow being equal to at least three times the total surface area of said vent bores.

8. Helmet according to claim 1, characterized in that the shape and the dimensions of said guide fin and of the relevant ribs, the dimensions and the inclinations of the air intakes, the dimensions and the outline of the lenticular hollow, the shape of the slider-baffle and the distance between the guide fin and the cap are determined on the basis of experimental tests carried out by using the wind tunnel.

* * * * *